United States Patent [19]

Hesterberg et al.

[11] Patent Number: 4,721,149

[45] Date of Patent: Jan. 26, 1988

[54] LOST FOAM CASTING SYSTEM WITH HIGH YIELD SPRUE

[75] Inventors: William G. Hesterberg, Rosendale; Wilfred A. Pagel, Fond du Lac; Gordon L. Stiller, Omro, all of Wis.

[73] Assignee: Brunswick Corporation, Skokie, Ill.

[21] Appl. No.: 15,744

[22] Filed: Feb. 17, 1987 (Under 37 CFR 1.47)

[51] Int. Cl.[4] ..... B22C 9/04; B22C 7/02

[52] U.S. Cl. ..... 164/244; 164/246; 164/34

[58] Field of Search ..... 164/244, 245, 246, 34, 164/35, 36

[56] References Cited

U.S. PATENT DOCUMENTS

| | | |
|---|---|---|
| 3,861,447 | 1/1975 | Hondo . |
| 3,863,706 | 2/1975 | Chandley . |
| 3,900,064 | 8/1975 | Chandley . |
| 4,112,997 | 9/1978 | Chandley . |
| 4,340,108 | 7/1982 | Chandley . |
| 4,616,689 | 10/1986 | Denis . |

FOREIGN PATENT DOCUMENTS

| | | |
|---|---|---|
| 1166188 | 3/1984 | Canada . |

OTHER PUBLICATIONS

Robert K. Buhr, "Panel: The Evaporative Foam Casting Process–Looking to the Future and New Technologies", Evaporative Foam Casting Technology II Program, Nov. 12–13, 1986, pp. 179–184.

Ezra L. Kotzin, "Metalcasting & Molding Processes", Cast Metal Series, An American Foundrymen's Society Publication, Des Plaines, Ill. 1981.

*Primary Examiner*—Kuang Y. Lin

*Attorney, Agent, or Firm*—Andrus, Sceales, Starke & Sawall

[57] ABSTRACT

A lost foam casting system (2) includes a sprue (8) have a receiving portion (56) for receiving molten metal (14) from a source (16), a distribution portion (58) with a plurality of radial fingers (59–62) for distributing the molten metal (14) radially outwardly, and a lower section (63) having a plurality of feed passages (35–38) receiving molten metal (14) from the respective radial fingers (59–62) and interconnected by thin flat support walls (39–42) providing a relatively rigid structure. Workpieces (18 and 20) and in-gates (23–25 and 26–28) are connected to the flat exterior surfaces (39 and 41) of the lower section (63) of the sprue (8) and fed with molten metal (14) from respective feed passages. The structure provides pattern assembly rigidity, excellent dimensional control, high casting yield, high ratio of casting weight to gating/sprue weight, high surface area to volume ratio facilitating escape of vapor and organic effluents, ease of pattern attchment by large outer flat sprue surfaces, accessibility of casting for ease in removal from the sprue, low total volume for reduction of buoyancy, and faster metal fill rates and faster cooling.

19 Claims, 7 Drawing Figures

LOST FOAM CASTING SYSTEM WITH HIGH YIELD SPRUE

BACKGROUND AND SUMMARY

The invention relates to a lost foam casting system, and more particularly to an improved gating sprue.

Lost foam casting is a known technique. A pattern assembly formed of evaporative foam material, for example gasifiable or liquifiable expanded polystyrene, which may be coated with a synthetic resin, or for example polymethylmethacrylate (PMMA), is placed in a flask and surrounded by unbonded particulate media, most commonly sand, though other particles can be used such as zirconia, magnetic iron spheres, etc. Upon application of molten metal to the pattern assembly, the foam material vaporizes and is replaced by the metal in the shape of the pattern assembly. The vaporized foam material escapes into the interstices in the sand. The pattern assembly includes one or more workpieces of given respective patterns for yielding cast metal parts, and a sprue connected by one or more in-gates to the workpieces for communicating the molten metal through the sprue to the in-gates and then to the workpieces. After cooling, the cast metal sprue and in-gates are broken away from the workpieces and discarded or recycled. The cast metal work pieces are then trimmed to yield the final product.

The present invention arose out of efforts to provide improved cast aluminum alloy cylinder heads for internal combustion engines in marine applications, though the invention is not limited thereto. Cylinder heads have a fairly complex pattern, and the fluid dynamics of the molten metal flow become critical because the flow must reach the extremities of the cylinder head pattern before solidification. Another particular requirement in casting cylinder heads is extremely tight dimensional repeatability in order to maintain precise dimensions and volumes of the internal combustion chambers. Too great a tolerance deviation will vary the compression ratio of the engine cylinders.

Pattern assembly rigidity is desired to maintain shape and dimensional integrity during the liquification cycle when molten metal is applied to the pattern assembly. The inherent mechanical strength of foam material is low and hence the pattern assembly must be supported or otherwise bolstered to maintain sufficient stiffness during the liquification cycle in order to prevent distortion. It is known in the prior art to wrap straps of polystyrene around the pattern assembly or to use extremely large thick stock sprues for the purpose of giving dimensional stability and stiffness. This approach suffers the disadvantage of wasting large amounts of cast metal in the rigging or sprue portion of the assembly for the sole purpose of adding rigidity, and which metal is not part of the cylinder head or other workpiece. This increased stock and thickness approach also requires longer cooling time, and furthermore adds to the amount of vaporized material which must be absorbed into the interstices in the sand. A further disadvantage is that the increased foam material adds to buoyancy during pattern processing and pattern investing and during the liquification cycle.

The present invention provides a relatively rigid pattern assembly without the above noted disadvantages. The invention provides rigidity while at the same time providing high casting yields, i.e. high ratio of workpiece cast metal weight to sprue cast metal weight.

The invention further provides a high surface area to volume ratio to permit escape of organic effluents and to promote rapid cooling. The invention provides low total volume of the sprue to conserve metal, and to reduce buoyancy during liquification, and hence reduce lift. The invention further promotes uniform filling at the in-gates, to facilitate complex pattern casting. The invention further facilitates ease of workpiece pattern attachment to the sprue, and accessibility of the cast workpieces for ease in removal from the sprue after solidification.

The high surface area sand contact to volume ratio facilitates vaporization of the foam material which in turn speeds the process. This is particularly desirable because it enables faster fill rates, which is desirable in complex patterns, or which may enable certain patterns not otherwise feasible.

The invention further facilitates noncritical placement of the in-gates and/or the workpieces to the sprue. The sprue is provided with multiple internal feed passages and with large area flat external sides affording noncritical placement of such in-gates and/or workpieces thereto, which flatness is maintained during the liquification cycle. The sprue provides a nonflexing repeatable affixation surface without increasing bulk density of the sprue.

In the preferred embodiment, the invention facilitates minimization of the number of glue joints on the pattern assembly. The invention enables a one-piece sprue. The workpieces are integrally formed with the in-gates, and the in-gates are glued to the sprue. The one-piece sprue and the minimal number of glue joints is a significant accomplishment. Prior assemblies have required numerous glue joints. A high number of glue joints is undesirable because of the high labor cost in the various attachments which must be made and because of the increased organic material which must be displaced and absorbed into the sand. This increased organic material may cause voids or defects in the final cast parts, and hence degrade quality.

In a further desirable aspect of the invention, the sprue is made in a mold splitting the sprue pattern diagonally such that any rough edges in the sprue pattern upon opening of the mold halves are formed at diagonal edges and not along flat affixation surfaces. Additionally, sand fill apertures are formed through flat support walls in the sprue between feed passages, which apertures are beveled to facilitate opening of the mold.

The preferred sprue further includes internal structure causing a draft during sand filling, facilitating full sand fill in and around the sprue, to provide maximum support and sand surface area contact.

DETAILED DESCRIPTION

Figure 1:
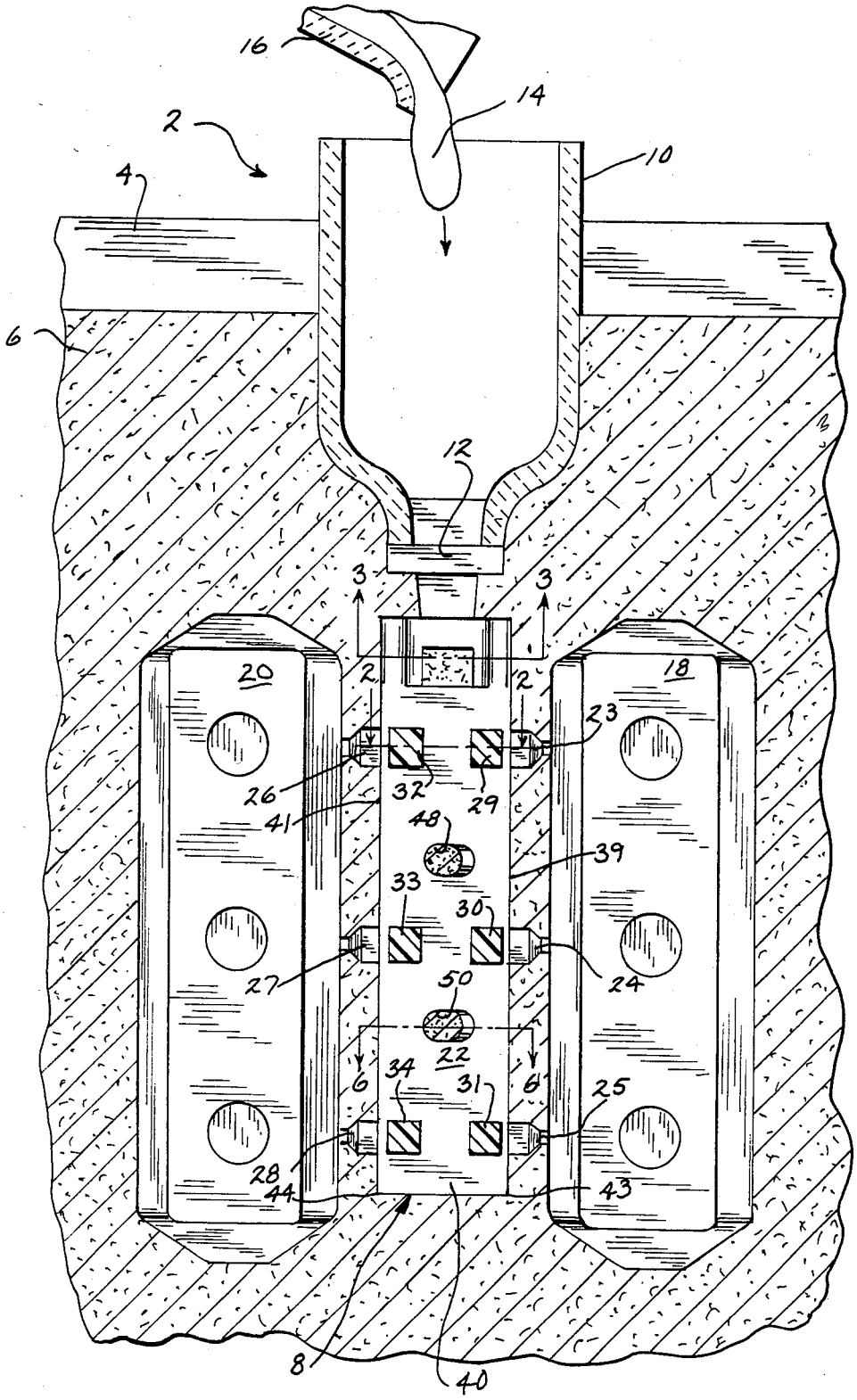
FIG. 1 is a side sectional view of a lost foam casting system in accordance with the invention.

FIG. 1 shows a lost foam casting system 2 in accordance with the invention. A flask 4, such as a cylindrical open topped barrel, is provided for holding unbonded particulate media 6, preferably sand, though other particles can be used, as noted above. Pattern assembly 8 is formed of evaporative foam material, for example gasifiable or liquifiable expanded polystyrene, which may be coated with a synthetic resin or with pattern wax, or for example polymethylmethacrylate (PMMA). Pattern assembly 8 is placed in the flask and then surrounded by the sand. A refractory funnel 10 is fitted on pattern assembly 8 and stopped against collar 12. The sand is poured into flask 4 to entirely surround pattern assembly 8 and the lower portion of funnel 10. The sand is then compacted by vibration. Molten metal 14 is then applied to the pattern assembly. The metal is poured from source 16 into funnel 10 and then flows to pattern assembly 8. The foam material of pattern assembly 8 vaporizes and is replaced by the metal in the shape of the pattern assembly. The vaporized foam material escapes into the interstices in the sand, all as is well known.

Pattern assembly 8 includes one or more workpieces such as 18 and 20 of given respective patterns for yielding cast metal parts. Pattern assembly 8 further includes a central vertical sprue 22 connected by one or more in-gates such as 23–25 and 26–28 to respective workpieces for communicating molten metal through sprue 22 to the in-gates 23–28 and then to the workpieces 18–20. In the particularly disclosed embodiment, the sprue is a hollow square member, FIG. 7, open at the bottom, and has six in-gates on each of its four sides. The six in-gates are arranged in two vertical columns of three in-gates each, as shown in FIG. 1 on the front facing surface 40 on the sprue, with the vertical column of in-gates 29–31 and the vertical column of in-gates 32–34. In-gates 29–31 are connected to a workpiece such as a cylinder head, comparably to the vertical column of in-gates 23–25 connected to cylinder head 18. Likewise, in-gates 32–34 are connected to a cylinder head. There are thus two cylinder heads per side of sprue 8, providing a total of eight cylinder heads. Each pair of cylinder heads on a side are interconnected by foam spacing members (not shown).

Figure 2:
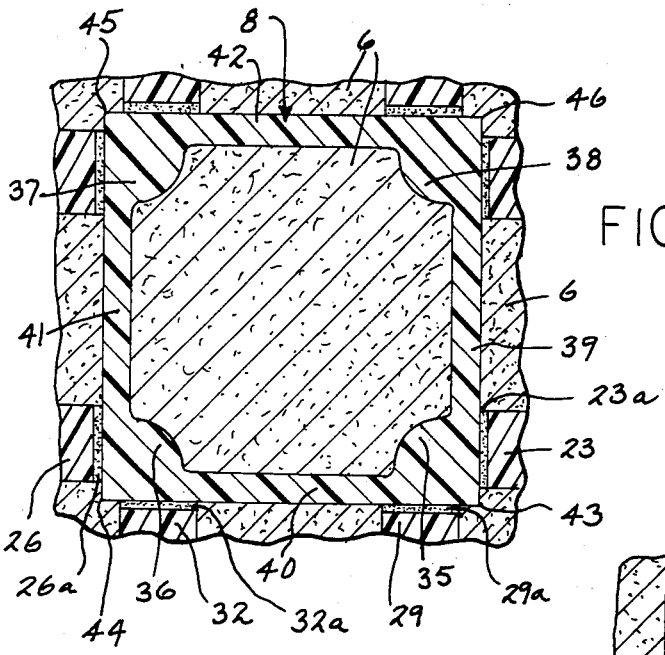
FIG. 2 is a sectional view taken along line 2—2 of FIG. 1.

Sprue 22 is a one-piece molded member. In-gates 23–25 are formed with cylinder head 18 and then glued to the flat side of the sprue, for example as shown in FIG. 2 at glue joint 23*a* for in-gate 23, glue joint 29*a* for in-gate 29, glue joint 26*a* for in-gate 26, and so on. Alternatively, the in-gates may be molded with the sprue and then glued to the respective cylinder heads, or further alternatively the in-gates may be formed as separate members and glued to the sprue and glued to the respective cylinder heads. During vaporization of the foam material of the pattern assembly, the glue also melts and is vaporized and escapes into the interstices in the sand. It is desirable to reduce the number of glue joints to reduce the amount of glue which must be vaporized because excessive amounts of same will cause voids or imperfections in the final cast metal part.

Sprue 8 has a plurity of vertical feed passages 35–38, FIG. 2, interconnected by support walls 39–42 providing a relatively rigid structure. Feed passages 35–38 pass substantially more molten metal than support walls 39–42. The in-gates are fed with molten metal from respective feed passages, for example in-gates 23–25 and 29–31 are fed with molten metal from feed passage 35. The support walls are thin flat members connected edge to edge to define an exterior perimeter surrounding a hollow interior, FIGS. 2 and 7. The exterior perimeter has a plurality of corners 43–46 at the respective intersections of the flat walls, with feed passages 35–38 being at respective corners 43–46. Feed passages 35–38 have a substantially larger cross sectional thickness than walls 39–42 and bulge inwardly from corners 43–46, such that the exterior of the sprue is flat from corner to corner to facilitate workpiece and in-gate placement. The placement of the in-gates is relatively noncritical because of the flat exterior surface of the sprue. Furthermore, the relatively rigid structure of the sprue prevents distortion during the fluidization cycle and hence maintains close mechanical tolerances, which is extremely important for cylinder heads. Feed passages 35–38 are shown as solid, FIG. 2, but may alternatively be hollow.

Figure 6:
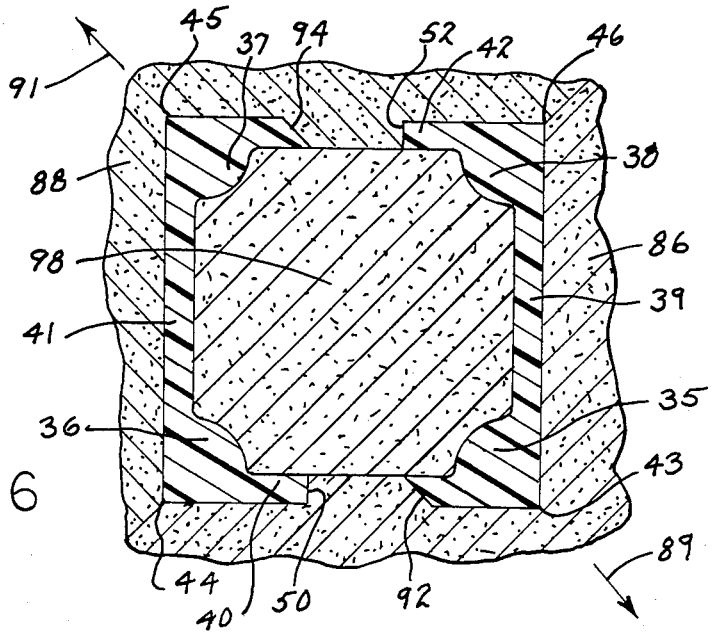
FIG. 6 is a sectional view taken along line 6—6 of FIG. 1.
Figure 7:
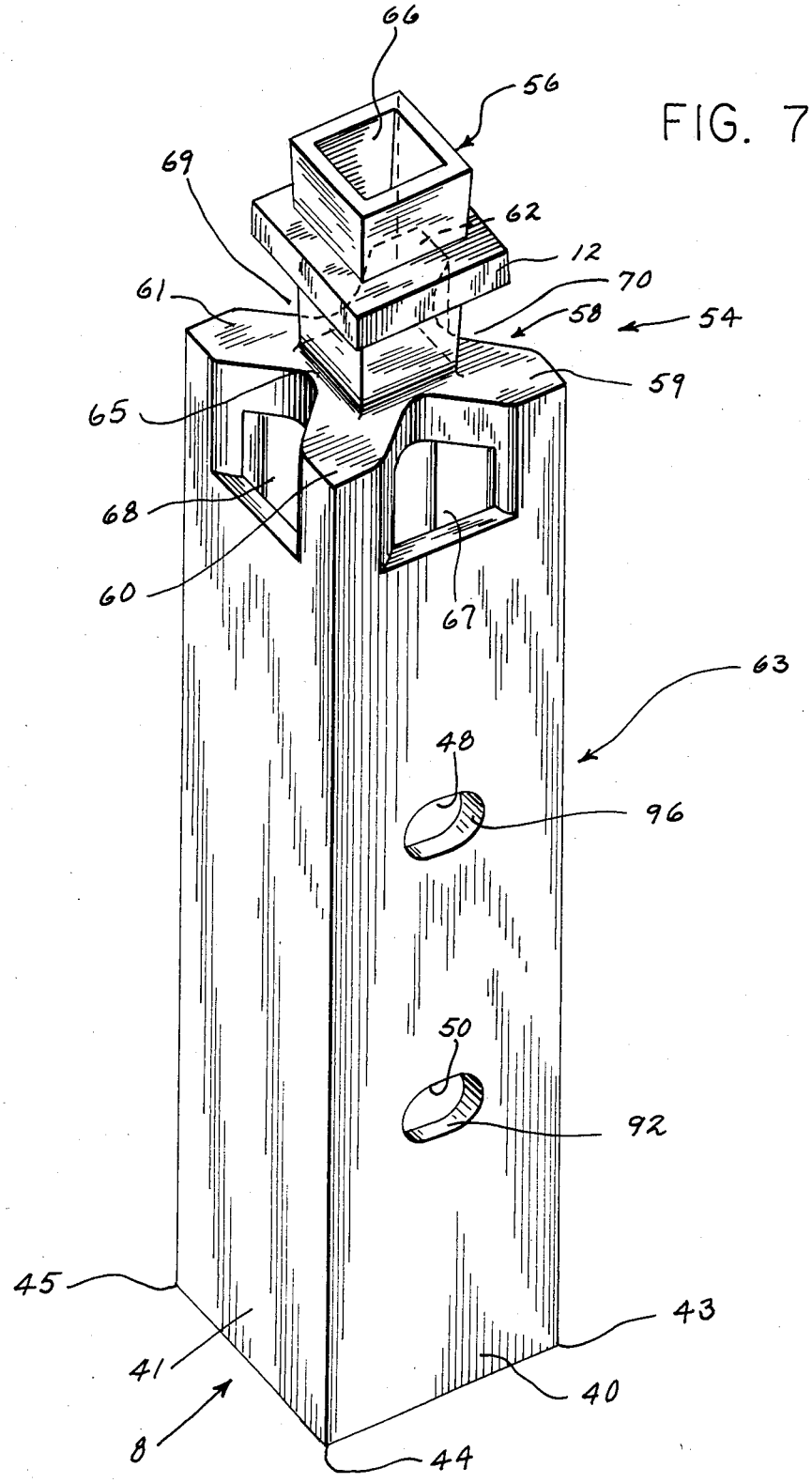
FIG. 7 is an isolated perspective view of the sprue of FIG. 1.

Thin flat support wall 40 has a pair of apertures 48 and 50, FIG. 7, for passing sand therethrough to fill the hollow interior of the sprue, to provide high surface area sand contact to volume ratio to maximize escape of vapor and to promote rapid cooling. Support wall 42 also has a pair of apertures, one of which 52 is shown in FIG. 6. Pattern assembly 8 is placed in flask 4, and the flask is then filled with sand 6. During such filling, sand will flow through apertures 50 and 52 and then through aperture 48 and its distally opposite aperture (not shown) in wall 42, to thus pass sand to the hollow interior of the sprue.

Sprue 8 has an upper section 54, FIG. 7, with a reciving portion 56 for receiving molten metal from source 16 through funnel 10, and with a distribution portion 58 for distributing the molten metal along a plurality of paths 59–62. The sprue has a lower section 63 as above described with the plurality of feed passages 35–38 receiving molten metal from respective said paths 59–62 and interconnected by respective support walls 39–42 providing a relatively rigid structure.

Receiving portion 56 is an upstanding stem member partially received within funnel 10 and having collar 12 therearound providing a stop for the funnel. The stem may be a solid foam member, but preferably is at least partially hollowed out to reduce bulk density and buoyancy during the liquification process and to reduce wasted metal. The hollow interior 66 of receiving portion 56 is closed at the bottom by the top 65 of receiving portion 58 and is not filled with sand. Molten metal flows through receiving portion 56 including hollow interior 66 to distribution portion 58. Distribution portion 58 has a plurality of spaced radial fingers forming the noted feed passages 59–62 and extending from the base of receiving portion 56 outwardly to respective feed passages 35–38 at corners 43–46. The spaces 67–70 between fingers 59–62 provide further apertures passing sand therethrough to the hollow interior of lower section 63.

Figure 3:
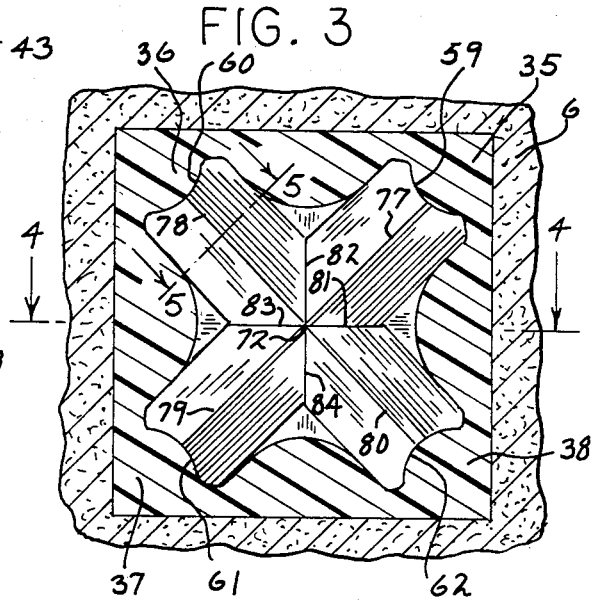
FIG. 3 is a sectional view taken along line 3—3 of FIG. 1.
Figure 4:
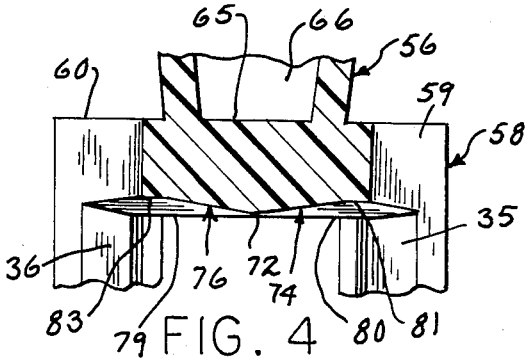
FIG. 4 is a sectional view taken along line 4—4 of FIG. 3.
Figure 5:
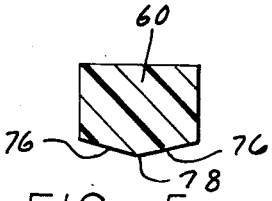
FIG. 5 is a sectional view taken along line 5—5 of FIG. 3.

Radial fingers 59–62 merge along their undersides at a central hub 72, FIG. 3 and 4. Central hub 72 has a face surface facing the hollow interior of lower sprue section 63. The hub face surface is tapered radially outwardly and upwardly from central point 72, as shown at tapers 74 and 76, FIG. 4. The radially outward portions of the taper are above central point 72 and hence are farther away from the hollow interior of lower sprue section 63, such that a draft is created along the taper during filling of sand through aperture spaces 67–70, to facilitate full sand fill to receiving portion 54. The downwardly facing hub face surface has a shallow serrated profile in circumferential cross section, FIGS. 3 and 4, such that the underside contour is drafted. The lower tips 77–80 of the serrated drafted contour closest to the hollow interior of lower sprue section 63 are along respective radial fingers 59–62. The upper tips 81–84 of the serrated drafted contour farthest away from the hollow interior of lower sprue section 63 are between respective radial fingers 59–62.

Sprue 8 is made in a mold having two pieces 86 and 88, FIG. 6, opening away from each other in directions 89 and 91 at a 45° angle to respective thin flat support walls 40 and 42 through which apertures such as 48, 50, 52, etc. are formed. Aperture 50 has a beveled side 52 along direction 89, and aperture 52 has a beveled side 94 along direction 91, to facilitate opening of the mold. The remaining apertures such as aperture 48 likewise have beveled sides such as 96 to facilitate opening of the mold. The formation of sprue 8 along a diagonal is important to prevent any slit lines along the flat surfaces 39–42 which may otherwise interfere with in-gate placement. Instead, any slit lines are formed along corners 44 and 46. The hollow interior of lower sprue section 63 is provided by vertical central pull portion 98 of the mold which is withdrawn vertically downwardly, and the hollow interior 66 of upper receiving portion 56 is provided by a vertically upward pull member (not shown).

It is recognized that various equivalents, alternatives and modifications are possible within the scope of the appended claims.

We claim:

1. A lost foam casting system comprising:

a flask for holding particulate media;

a source of molten metal;

a pattern assembly formed of evaporative foam material and placed in said flask and surrounded by said particulate media, such that upon application of said molten metal to said pattern assembly, said foam material vaporizes and is replaced by said metal in the shape of said pattern assembly, said vaporized foam material escaping into the interstices in said particulate media, said pattern assembly comprising one or more work pieces of given respective patterns for yielding cast metal parts and comprising a sprue connected by one or more in-gates to said workpieces for communicating said molten metal through said sprue to said in-gates and then to said workpiece, said sprue having a plurality of feed passages interconnected by support walls providing a relatively rigid structure, said feed passages passing more molten metal than said support walls, said in-gates being fed with molten metal from respective said feed passages.

2. The invention according to claim 1 wherein said support walls are thin flat members connected edge to edge to define an exterior perimeter surrounding a hollow interior, said exterior perimeter having a plurality of corners at the respective intersections of said flat walls, said feed passages being at respective said corners.

3. The invention according to claim 2 wherein said feed passages have a substantially larger cross sectional thickness than said walls and bulge inwardly from said corners to said hollow interior, such that said exterior is flat from corner to corner to facilitate workpiece and in-gate placement.

4. The invention according to claim 2 comprising aperture means through at least one of said support walls for passing particulate media therethrough to fill said hollow interior to provide high surface area particulate media contact to volume ratio to maximize escape of vapor and to promote rapid cooling.

5. The invention according to claim 4 wherein said sprue is made in a mold comprising two pieces opening away from each other in a given direction at an angle to the flat support wall through which said aperture means is formed, said aperture means comprising a beveled aperture through said last mentioned support wall, the bevel being in said given direction to facilitate said opening of said mold.

6. The invention according to claim 5 wherein said sprue is an integrally molded one piece member.

7. A lost foam casting system comprising:

a flask for holding particulate media;

a source of molten metal;

a pattern assembly formed of evaporative foam material and placed in said flask and surrounded by said particulate media, such that upon application of said molten metal to said pattern assembly, said foam material vaporizes and is replaced by said metal in the shape of said pattern assembly, said vaporized foam material escaping into the interstices in said particulate media, said pattern assembly comprising one or more workpieces of given respective patterns for yielding cast metal parts and comprising a sprue connected by one or more in-gates to said workpieces for communicating said molten metal through said sprue to said in-gates and then to said workpieces, said sprue having a first section with a receiving portion for receiving molten metal from said source of molten metal and with a distribution portion for distributing said molten metal along a plurality of paths, said sprue having a second section with a plurality of feed passages receiving molten metal from respective said paths and interconnected by support walls providing a relatively rigid structure, said feed passages passing more molten metal than said support walls, said in-gates being connected to said second section of said sprue and being fed with molten metal from respective said feed passages.

8. The invention according to claim 7 wherein said distribution portion comprises a plurality of spaced radial fingers extending from said receiving portion outwardly to respective said feed passages.

9. The invention according to claim 7 wherein said support walls are thin flat members connected edge to edge to define an exterior perimeter surrounding a hollow interior, said exterior perimeter having a plurality of corners at the respective intersections of said flat walls, said feed passages being at respective said corners, and wherein said distribution portion comprises a plurality of spaced radial fingers extending from said receiving portion outwardly to respective said feed passages at respective said corners, the spaces between said fingers passing particulate media therethrough to said hollow interior of said second section.

10. The invention according to claim 9 wherein said radial fingers merge at a central hub at said receiving portion, said hub having a face surface facing said hollow interior of said second section, said face surface being tapered radially outwardly from a central point, the radially outward portions of the taper being farther away from said hollow interior of said second section, such that a draft is created along said taper during filling of said particulate media through said spaces between said fingers, to facilitate full particulate media fill to said receiving portion.

11. The invention according to claim 10 wherein said hub face surface has a shallow serrated profile in circumferential cross section such that the underside contour is drafted, the tips of the serrated drafted contour closest to said hollow interior of said second section being along said radial fingers, the tips of the serrated drafted contour fartherest away from said hollow interior of said second section being between said radial fingers.

12. A lost foam casting system comprising:

a flask for holding particulate media;

a source of molten metal;

a pattern assembly formed of evaporative foam material and placed in said flask and surrounded by said particulate media, such that upon application of molten metal to said pattern assembly, said foam material vaporizes and is replaced by said metal in the shape of said pattern assembly, said vaporized foam material escaping into the interstices in said particulate media, said pattern assembly comprising one or more workpiece of given respective patterns for yielding cast metal parts and comprising a sprue connected by one or more in-gates to said workpieces for communicating molten metal through said sprue to said in-gates and then to said workpiece, said sprue comprising a hollow member with means for passing particulate media to the interior thereof, said in-gates being connected to the exterior of said hollow member, said particulate media engaging and supporting said interior and said exterior of said hollow member to provide high surface area particulate media contact to volume ratio to maximize escape of vapor and to promote rapid cooling.

13. The invention according to claim 12 wherein said sprue comprises input means in said particulate media receiving molten metal from said source of molten metal and transferring said molten metal radially outwardly to said hollow member.

14. The invention according to claim 13 wherein said input means includes a hollow portion without said particulate media.

15. The invention according to claim 13 wherein said means for passing particulate media to the interior of said hollow member comprises aperture means formed in said input means.

16. The invention according to claim 15 wherein said means for passing particulate media to the interior of said hollow member further comprises aperture means through said hollow member.

17. A lost foam casting sprue comprising a molded member of evaporative foam material comprising a first section with a receiving portion for receiving molten metal and with a distribution portion comprising a plurality of spaced radial fingers extending from said receiving portion outwardly along a plurality of paths, and comprising a second section with a plurality of thin flat support walls connected edge to edge to define an exterior perimeter surrounding a hollow interior, said exterior perimeter having a plurality of corners at the respective intersections of said flat walls, said second section including a plurality of feed passages at respective said corners and supported by said thin flat walls therebetween providing a relatively rigid structure, said plurality of radial fingers being connected to respective said feed passages, said feed passages passing substantially more molten metal than said support walls.

18. The invention according to claim 17 wherein the spaces between said radial fingers provide first aperture means for passing particulate media therethrough to said hollow interior of said second section, and comprising second aperture means through at least one of said support walls for passing particulate media therethrough to said hollow interior, and wherein said feed passages have a larger cross sectional thickness than said support walls and bulge inwardly from said corners toward said hollow interior.

19. The invention according to claim 17 wherein said sprue is an intergrally molded one-piece member.

* * * * *